US006076873A

United States Patent [19]

Jung

[11] Patent Number: 6,076,873

[45] Date of Patent: Jun. 20, 2000

[54] MAGNETIC LIFTING APPARATUS

[76] Inventor: Hyung Jung, Byucksan Apt. 122-904, Gaya 2-Dong, Pusanjin-ku, Pusan, Rep. of Korea

[21] Appl. No.: 09/215,137

[22] Filed: Dec. 18, 1998

[30] Foreign Application Priority Data

Jul. 24, 1998 [KR] Rep. of Korea ..... 98-30974

[51] Int. Cl.[7] ..... B66C 1/04; H01F 7/04

[52] U.S. Cl. ..... 294/65.5; 335/288; 335/295

[58] Field of Search ..... 294/65.5; 335/285, 335/288, 291, 294–298, 302, 306

[56] References Cited

U.S. PATENT DOCUMENTS

| | | | |
|---|---|---|---|
| 2,471,067 | 5/1949 | Hitchcock | 335/295 |
| 4,055,824 | 10/1977 | Baermann | 335/288 |
| 4,250,478 | 2/1981 | Cardone et al. | 335/288 |
| 4,314,219 | 2/1982 | Haraguchi | 335/295 |
| 4,379,277 | 4/1983 | Braillon | 335/295 |
| 4,465,993 | 8/1984 | Braillon | 335/295 X |
| 5,166,654 | 11/1992 | Doyelle | 335/288 |
| 5,435,613 | 7/1995 | Jung | 294/65.5 |

*Primary Examiner*—Johnny D. Cherry

[57] ABSTRACT

A magnetic lifting apparatus includes a plurality of magnetic substances, a plurality of rotor seat members, magnetic rotors, and permanent magnets alternately aligned with the plurality of magnetic substances. The apparatus includes stopping members for stopping rotation of magnetic rotors in a one way direction whereby upon lifting the operating member, the magnetic lifting apparatus either has a magnetic activity or no magnetic activity so as to attach to or release from an object, respectively.

10 Claims, 8 Drawing Sheets

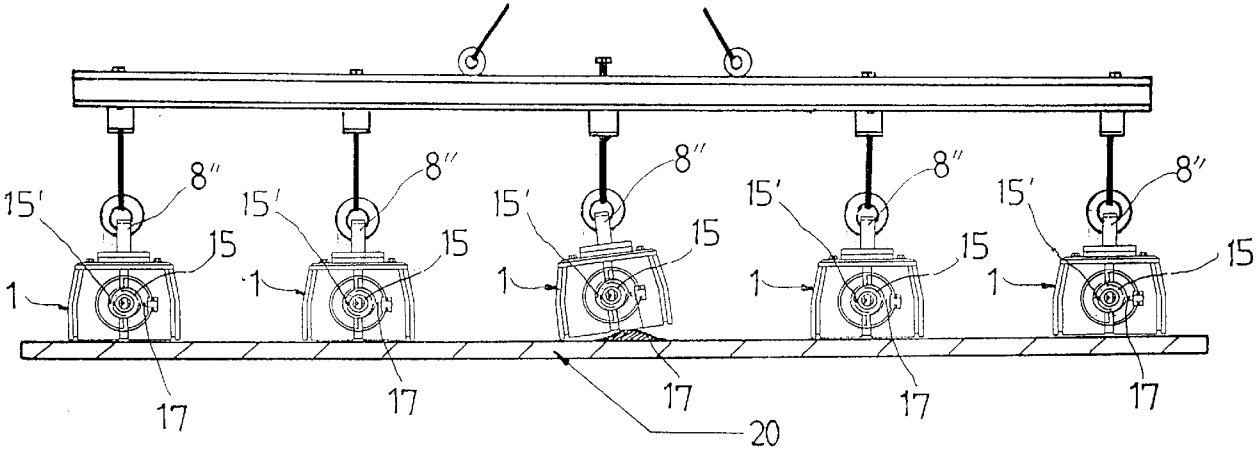
FIG. 16
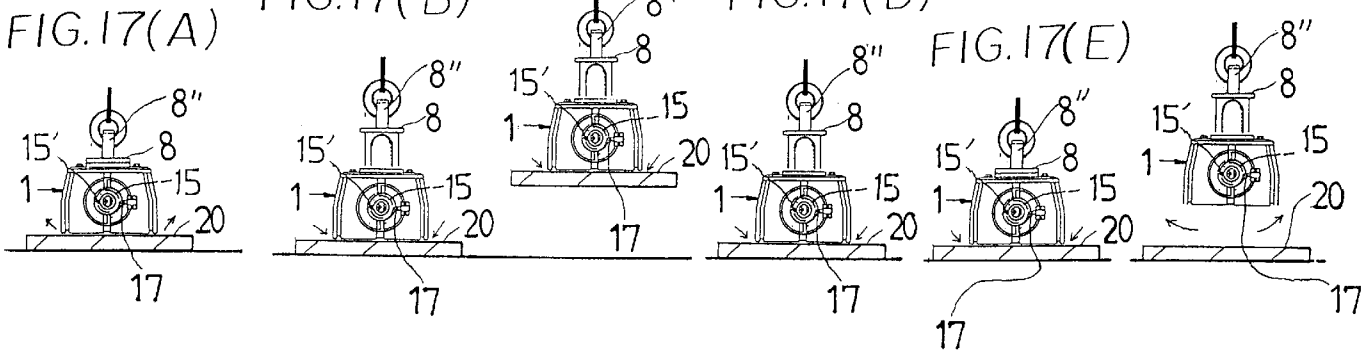
FIG. 17(A)
FIG. 17(B)
FIG. 17(C)
FIG. 17(D)
FIG. 17(E)
FIG. 17(F)

MAGNETIC LIFTING APPARATUS

BACKGROUND OF THE INVENTION

1. Field of the Invention

The present invention relates to a magnetic lifting apparatus and more particularly, to an improved magnetic lifting apparatus including a plurality of magnetic substances, a plurality of rotor seat members rotors and permanent magnets alternately aligned with the plurality of magnetic substances, an operating member, and stopping member for stopping in a one-way direction. Upon lifting the operating member, when the magnetic rotors match with permanent magnets in a same magnetic polarity, the magnetic lifting apparatus attracts an object to be moved or lifted. After moving or lifting, and when the magnetic rotors become unmatched with the permanent magnets in an opposed magnetic polarity, the magnetic lifting apparatus releases the object.

2. Description of the Related Art

Generally, several magnetic apparatuses for use in lifting objects are known in the art. However, such magnetic apparatuses have proved to be unpractical for lifting and releasing objects.

In order to solve the above problems, U.S. Pat. No. 5,435,613 discloses a magnetic lifting apparatus which includes a plurality of magnetic substances, a plurality of pairs of first permanent magnets, a plurality of rotors having a pair of second permanent magnets, respectively, and an on/off switch handle connected to the rotors whereby upon rotating the on/off switch handle, the magnetic apparatus has a magnetic activity or no magnetic activity so as to attach to or release the object.

However, this patented magnetic lifting apparatus is difficult to operate manually, and has a complicated structure. It has high manufactory costs, in addition to being heavy in weight. Also during impacts, the machine has some difficulty holding on to objects.

SUMMARY OF THE INVENTION

Accordingly, it is an object of the present invention to provide an improved magnetic lifting apparatus, which eliminates the above problems encountered with a conventional apparatus.

Another object of the present invention is to provide a magnetic lifting apparatus including a plurality of magnetic substances, a plurality of rotor seat members with magnetic rotors and permanent magnets alternately aligned with the plurality of magnetic substances, and stopping members for stopping in a one way direction whereby upon lifting an operating member, the magnetic lifting apparatus either has a magnetic activity or no magnetic activity so as to attach to or release from an object, respectively.

An object of the present invention is to improve a magnetic lifting apparatus by providing a top cover, front and rear wall covers, and side wall covers having screw bolts for firmly attaching to the magnetic substances through a melting method, and non-magnetic center zones attached to the magnetic substances through a melting method whereby the magnetic lifting apparatus can hold objects during impact.

Still another object of the present invention is to provide a magnetic lifting apparatus which is simple in structure, inexpensive to manufacture, durable in use, and refined in appearance.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 16 is a front elevational view of a number of the magnetic lifting apparatus according to the present invention showing lift and movement of a long and wide steel plate using five apparatuses; and FIGS. 17(A)–17(F) are front elevational views of the magnetic lifting apparatus according to the present invention showing operation thereof in a series of steps.

DESCRIPTION OF THE PREFERRED EMBODIMENTS

Figure 1:
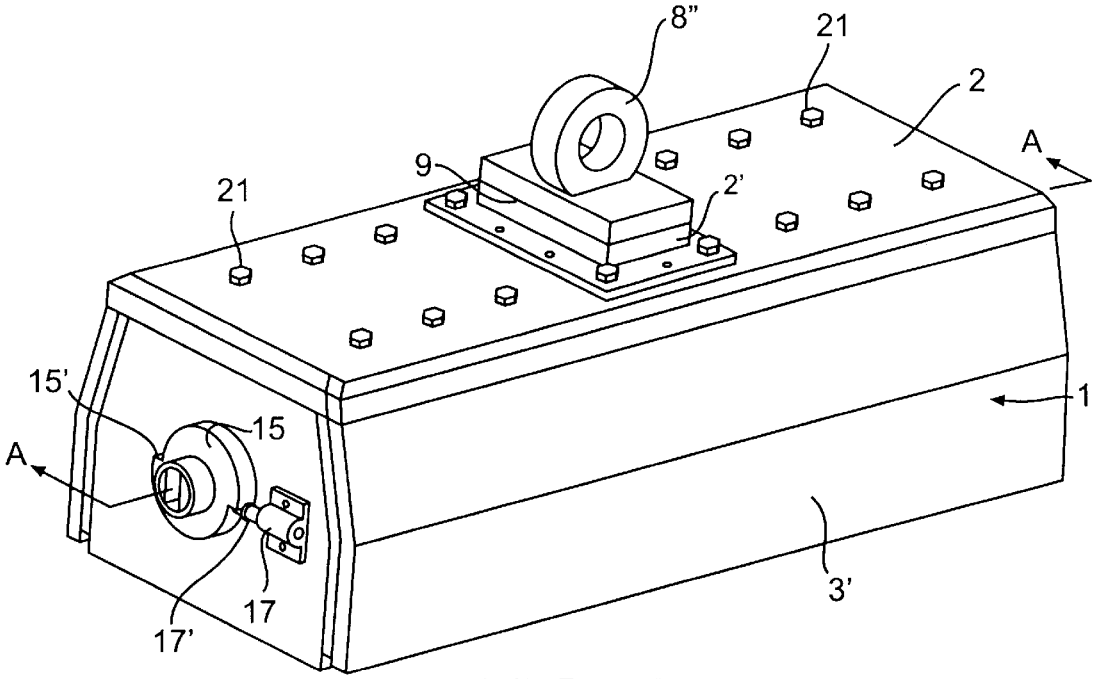
FIG. 1 is a perspective view of the magnetic lifting apparatus according to the present invention.
Figure 2:
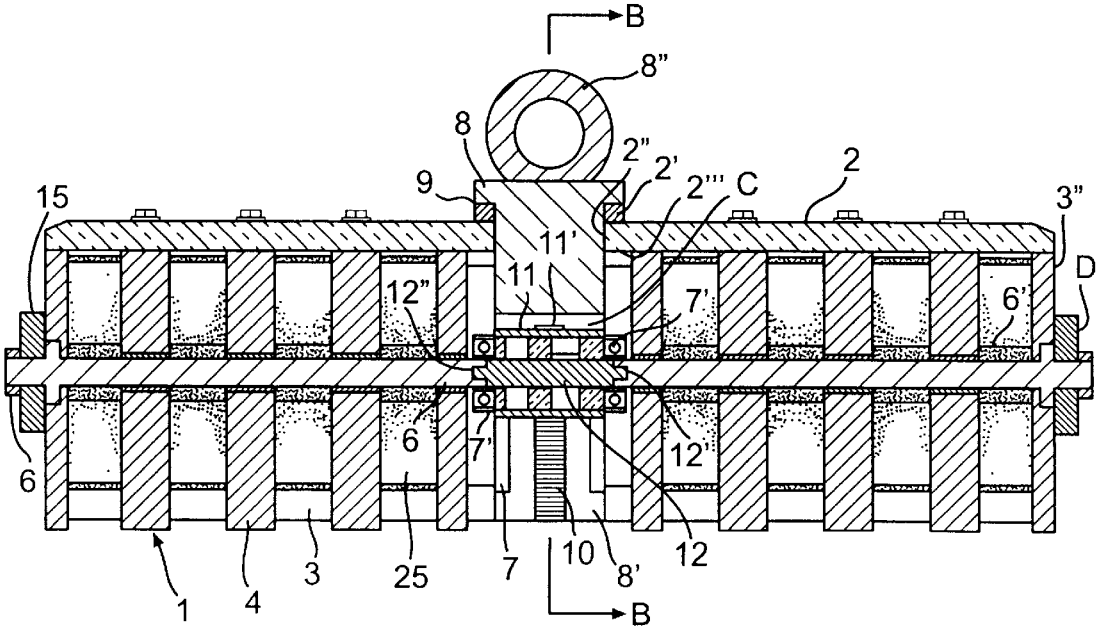
FIG. 2 is a sectional view taken along line A—A of FIG. 1.
Figure 3:
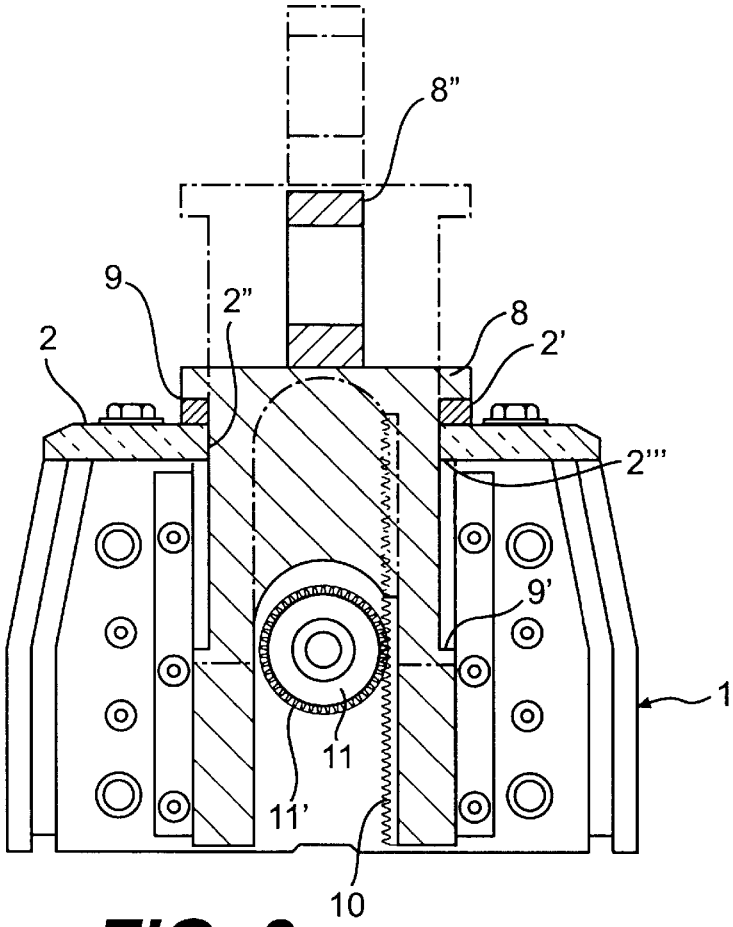
FIG. 3 is a cross-sectional view taken along line B—B of FIG. 2.

Referring now in detail to the drawings for the purpose of illustrating preferred embodiments of the present invention, the magnetic lifting apparatus as shown in FIGS. 1, 2, and 3, comprises a body member 1 having a top cover 2, a bottom plate 3 and tapered side walls 3', a tetragonal operating member disposed in a tetragonal opening 2" which forms in the center portion of the top cover 2, a plurality of rotor seat members 25 each having a magnetic rotor and a pair of permanent magnets, and a plurality of magnetic substances 4 alternately aligned with the rotor seat members 25 in the body member 1. Each side wall 3' has an inwardly angled portion extended from a top angle of the top cover 2.

Figure 6:
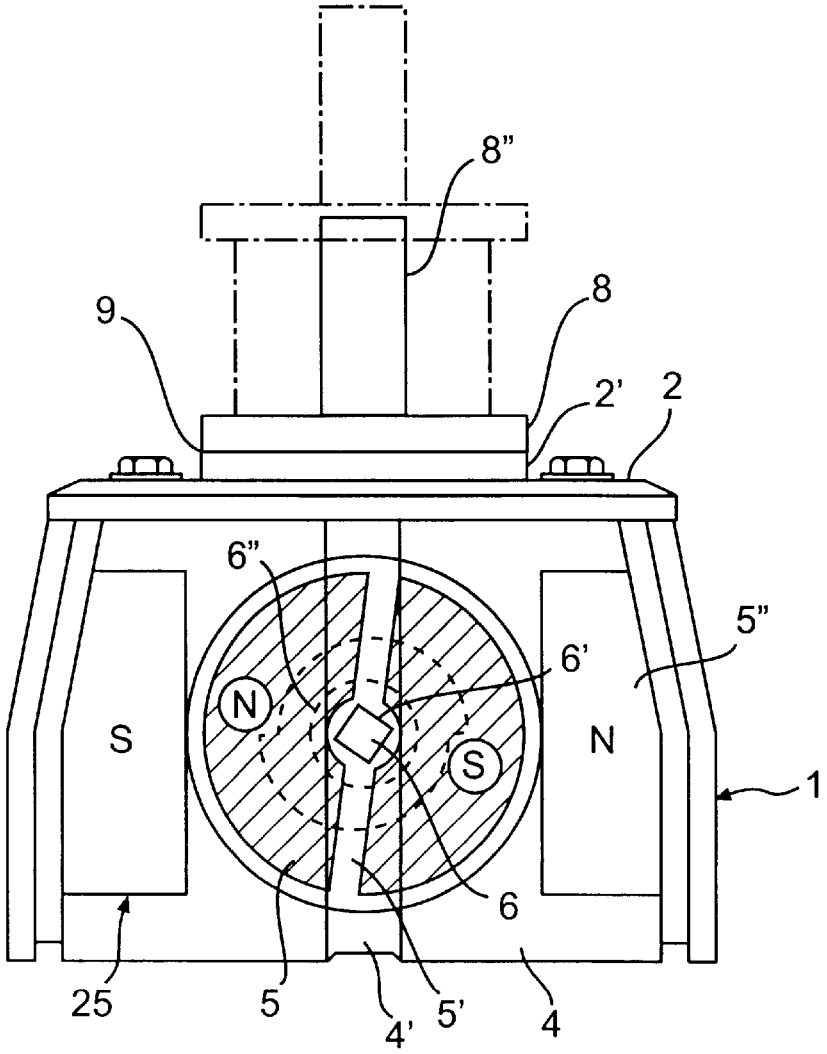
FIG. 6 is a front elevational view of a rotor seat member of the magnetic lifting apparatus according to the present invention in an off-position.

As shown in FIG. 6, each rotor seat member 25 includes a magnetic rotor 5 having a first nonmagnetic center zone 5' and a first pair of permanent magnets N and S disposed at the left and right sides of the first central zone 4', and a second N and S disposed at the left and right sides of the magnetic rotor 5. The rotor seat member 25 and the magnetic substances are about 3 to 10 in number.

Each magnetic rotor 5 is rotatably disposed between the pair of permanent magnets N and S and includes a tetragonal axial aperture 6' for slidably receiving a tetragonal axle 6. Also, each magnetic substance 4 includes a large axial aperture 6" for freely receiving the tetragonal axle 6 and a second non-magnetic center zone 4' having a multiangular configuration. The magnetic substances 4 are attached to the top cover 2 by screw bolts 21. The magnetic substances are made of materials which can have a magnetic activity. Also, the magnetic substances attach to the top cover 2 through screw bolts and while the magnetic substances are attached to the side walls 3' by a melting method.

As shown in FIGS. 2 and 3, the tetragonal operating member 8 having a link 8" is moveably put on a tetragonal seat 2' which is disposed on the circumference of the tetragonal opening 2" through an upper edge portion 9 disposed at the upper portion thereof when the operating member 8 goes down, and when the operating member 8 goes up, a lower edge portion 9' disposed at the lower portion thereof is stopped by a projection 2'" of the opening 2".

Referring in detail to FIGS. 2, 3, 4, and 5, a tubular body member 11 disposed within a hollow portion 8' of the opening 2" and supported on a support 7 includes a ring gear 11' surrounded on the central outer surface thereof, a connecting axle 12 having a pair of convex ends 12' extended from both ends thereof for engaging with a pair of central concave ends 12" of the tetragonal axle 6. A circular plate 14 is disposed therein, and a pair of bearings 7' are disposed at both engaging points thereof and a rack gear 10 is in gearing relationship with the ring gear 11'. The rack gear 10 is disposed in the lower hollow portion 8', and connected to the operating member 8.

Figure 5:
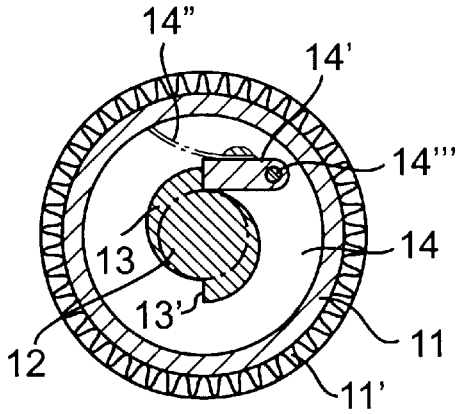
FIG. 5 is a cross-sectional view taken along line I—I of FIG. 4.

As shown in FIG. 5, the circular plate 14 of the tubular body member 11 contains cam configured members 13 mounted on the connecting axle 12. The cam members 13 have end stopping portions which contact a cam stopper 14' pivotally connected to a pivot pin 14'". The cam stopper 14' is biased with a resilient spring 14" fixed to the circular plate 14 whereby after the ring gear 11' rotates in a clockwise direction, the ring gear 11' stops thereto and when the ring gear 11' rotates in a counter clockwise direction, the ring gear 11' can rotate freely (FIG. 3).

Figure 7:
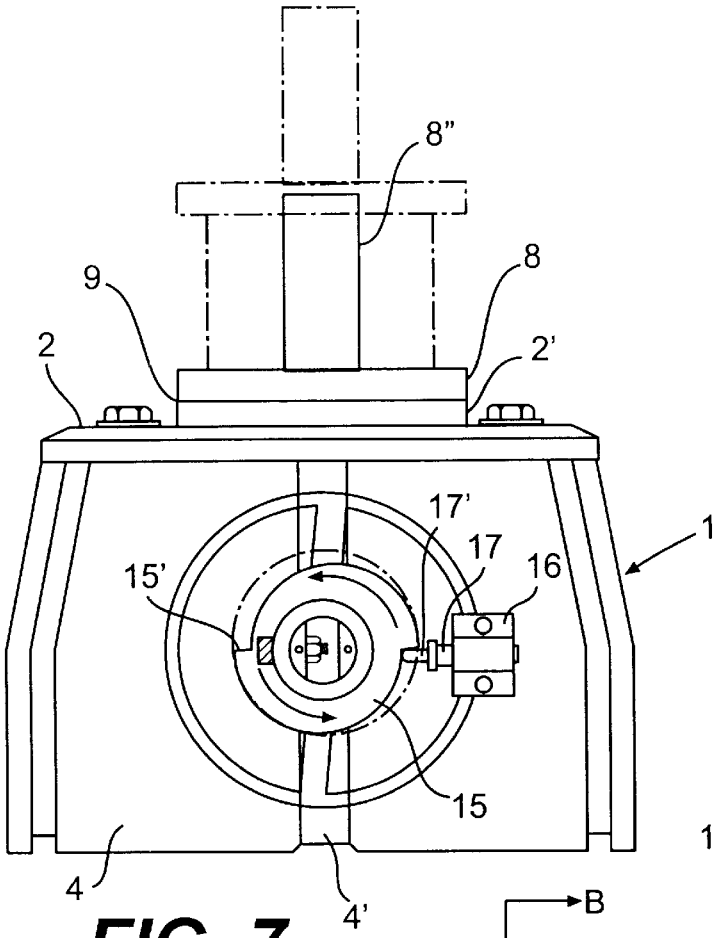
FIG. 7 is a front elevational view of a circular magnetic polarity fixing member of the magnetic lifting apparatus according to the present invention showing operation thereof.

As shown in FIGS. 1 and 7, a pair of circular magnetic polarity fixing members 15 are attached to both outside ends of the tetragonal axle 6 and are disposed on front and rear outer surfaces of the body member 1. Each magnetic polarity fixing member 15 having a cam configuration includes a pair of stopping portions 15' thereof for contacting a stopper lever 17' of a stopper 17 disposed at a stopper supporting plate 16 when the tetragonal axle 6 rotates in the clockwise direction. The stopper 17 is mounted on the outer surface of the body member 1.

Referring in detail to FIG. 7, the stopping portion 15' sets up in a slant position of approximately 5–7° about the second magnetic center zone 4' since the first magnetic center zone 5' of the rotor seat member 5 sets up in a slant position of approximately 5–7° about the vertical line so as to stop in a one way direction.

Accordingly, when the magnetic polarity fixing members 15 are in an on-position, stopper 17 contacts stopping portion 15 and when the magnetic polarity of the pair of permanent magnets N and S of the magnetic rotor 5 are the same as the magnetic polarity of the pair of permanent magnets N and S of the rotor seat member 25. On the contrary, the magnetic polarity fixing members 15 are in an off-position, when the stopper 17 releases stopping portion 15'.

Figure 8B:
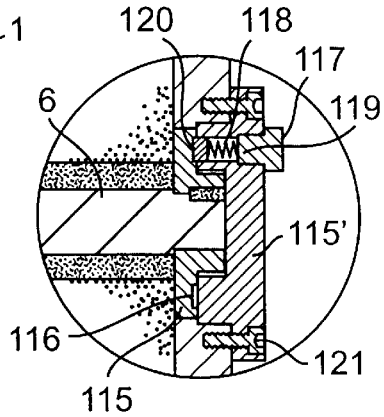
FIGS. 8(A) and 8(B) are sectional views of another embodiment of the magnetic lifting apparatus according to the present invention showing another circular magnetic polarity fixing member.
Figure 8A:
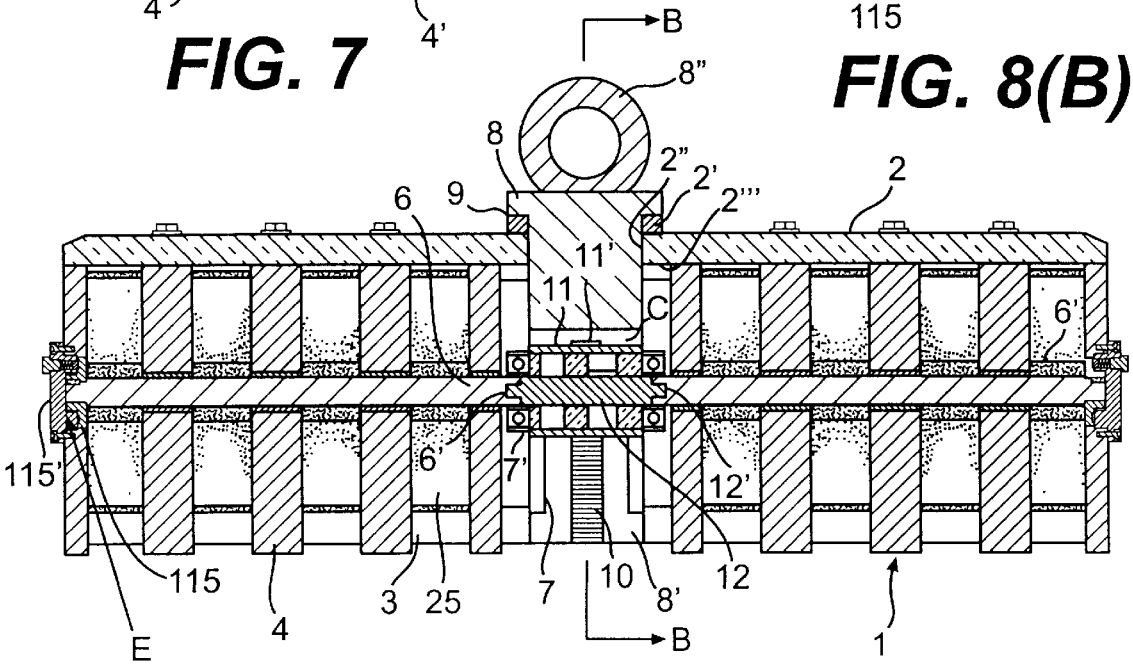
Figure 9:
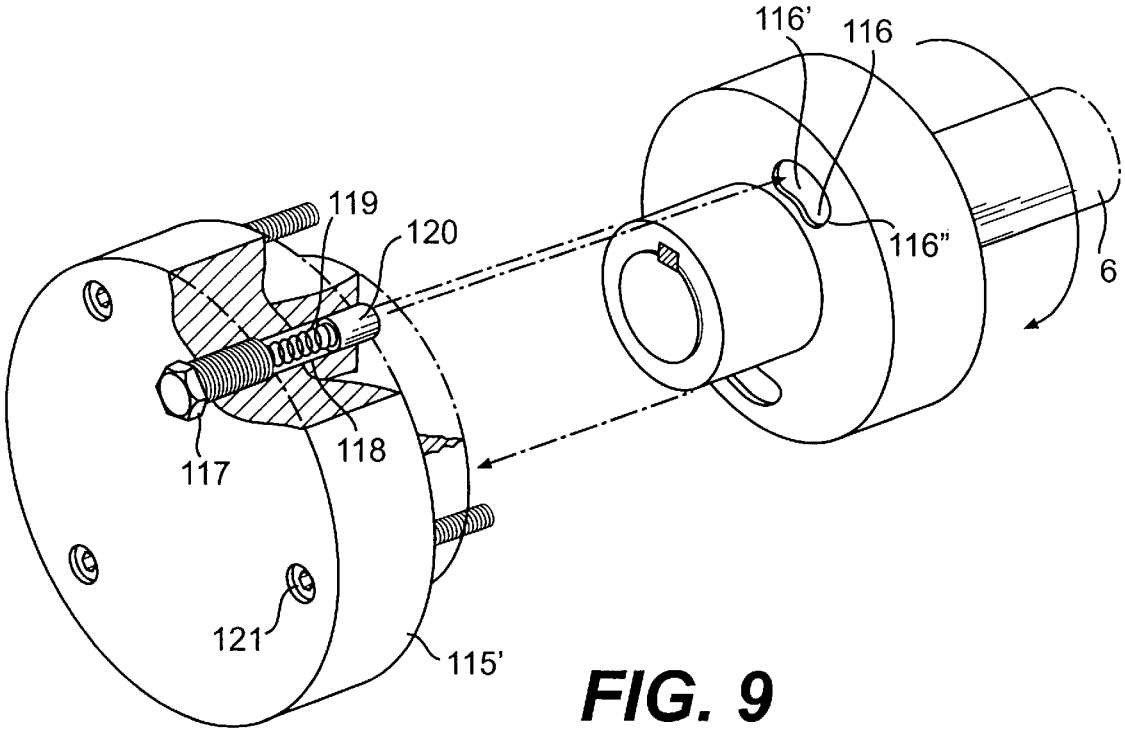
FIG. 9 is an exploded perspective view of an "E" portion of FIG. 8 containing cut-away portions in order to illustrate the construction of another circular magnetic polarity fixing member.
Figure 10:
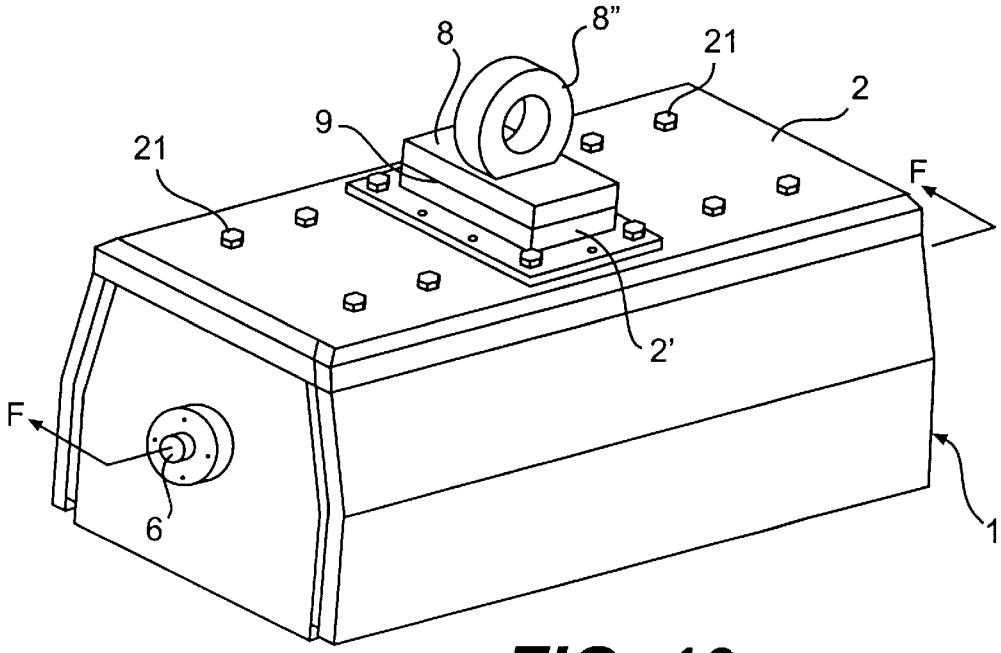
FIG. 10 is a perspective view of a third embodiment of the magnetic lifting apparatus according to the present invention showing a third circular magnetic polarity fixing member.
Figure 11:
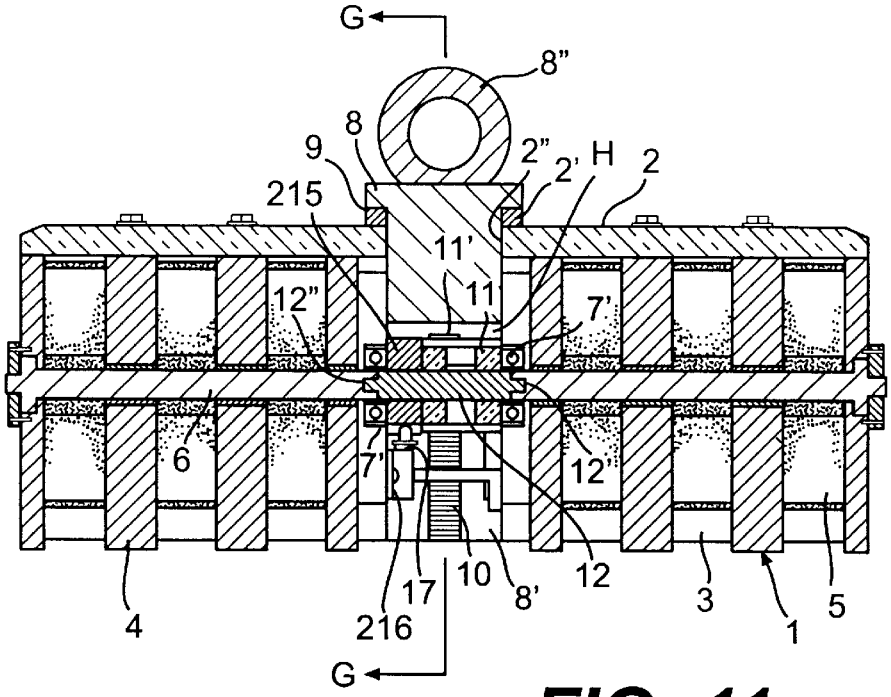
FIG. 11 is a sectional view taken along line F—F of FIG. 10.
Figure 12:
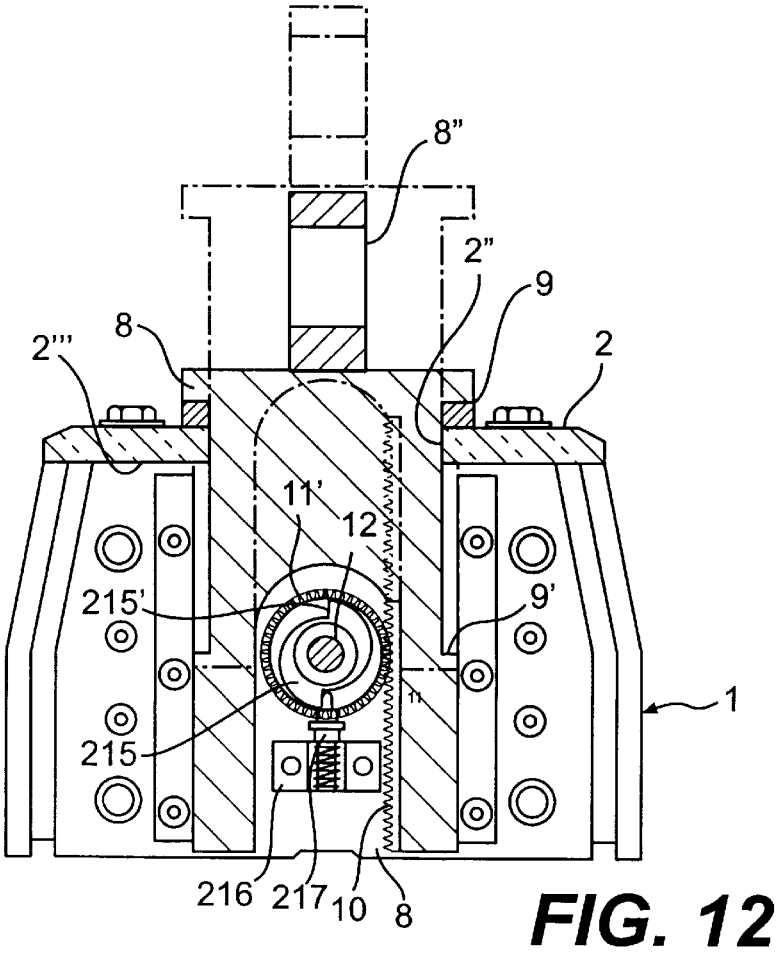
FIG. 12 is a cross-sectional view taken along line G—G of FIG. 11.
Figure 13:
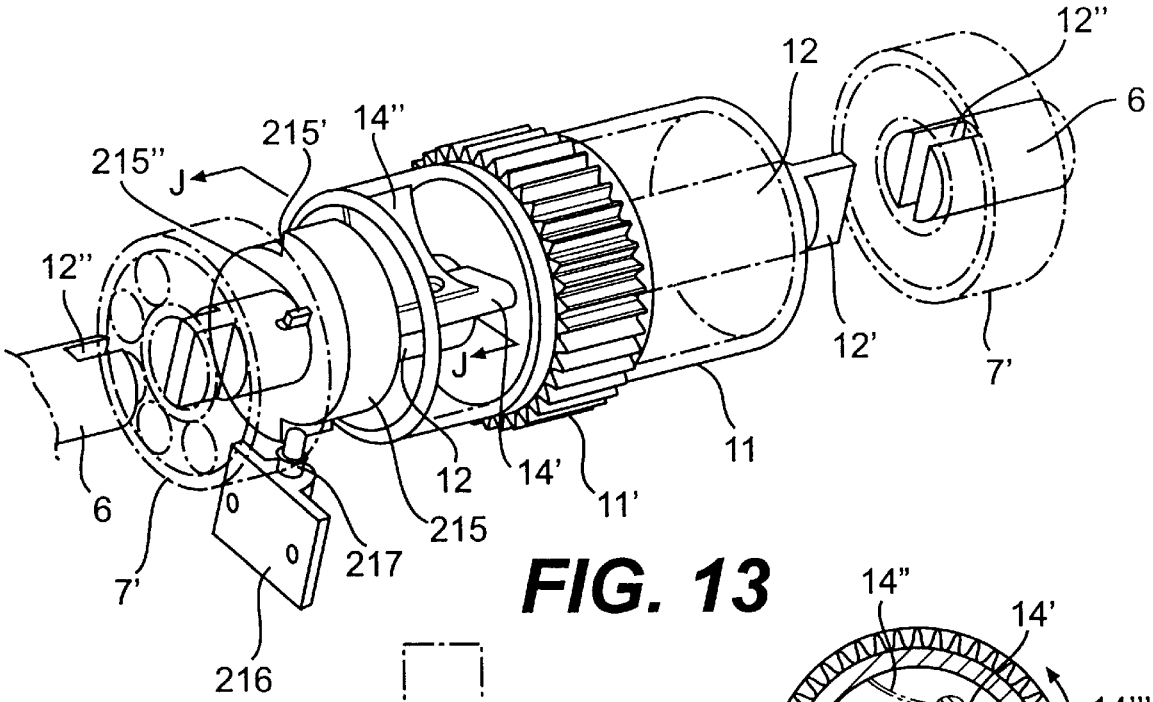
FIG. 13 is an exploded perspective view of "H" portion of FIG. 11.
Figure 14:
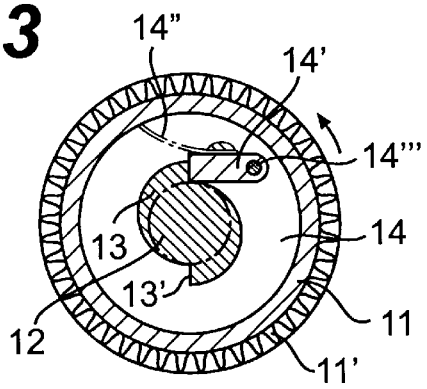
FIG. 14 is a cross-sectional view taken along line J—J of FIG. 13.
Figure 15:
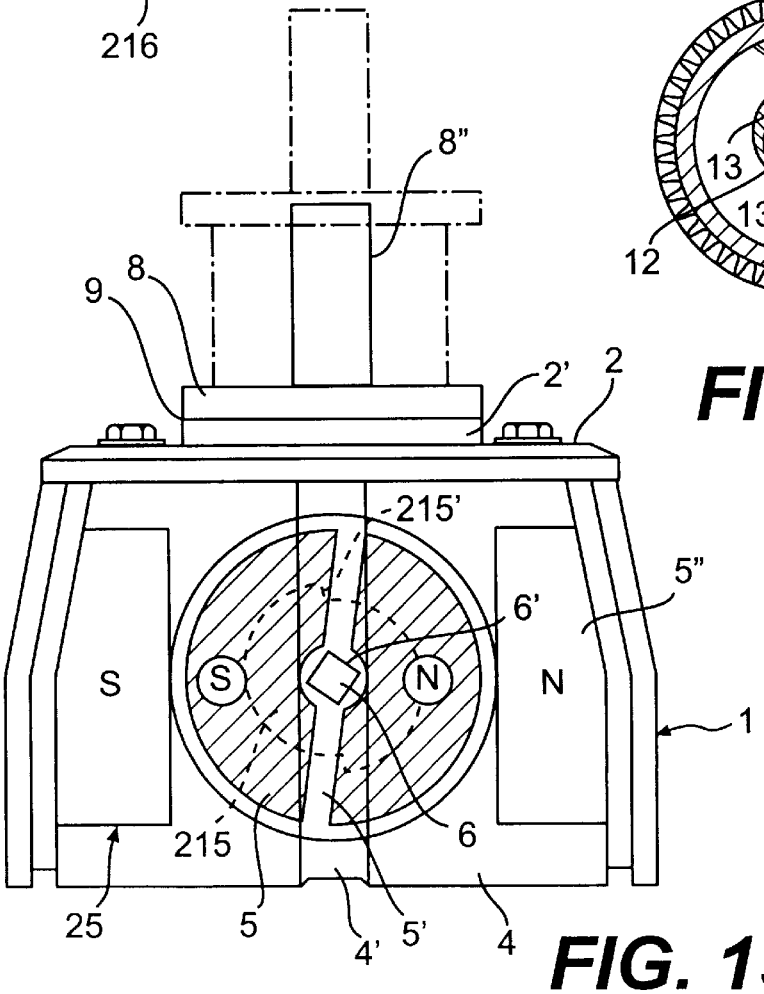
FIG. 15 is a front elevational view of a circular magnetic polarity fixing member of the magnetic lifting apparatus according to the present invention showing an operation thereof.

Referring in detail to FIGS. 8(A), 8(B) and 9, there is illustrated an additional embodiment of a circular magnetic polarity fixing member 115 of the magnetic lifting apparatus in accordance with the present invention. A pair of magnetic polarity fixing members 115 are attached to both ends of the tetragonal axle 6. Each circular magnetic polarity fixing member 115 includes a circular cap 115' for covering the circular fixing member 115. The cover 115' is fastened by cap bolts 121, a pair of stopping recesses 116 symmetrically disposed thereon, and a stopping rod 120 attached to the circular cap 115' through a control bolt 117 for selectively engaging in the pair of stopping recesses 116.

Each stopping recess 116 contains a slant surface 116' and a raised stopping portion 116" for stopping the stopping rod 120 in the one way direction through the slant surface and the raised stopping portion 116. The stopping rod 120 disposed within a hole 118 is provided with a spring 119 inserted between the stopping rod 120 and the control bolt 117. Accordingly, the stopping rod 120 stops in the stopping recess 116 of the circular magnetic polarity fixing member 115.

Referring in detail to FIGS. 10–14, there is illustrated another additional embodiment of a circular magnetic polarity fixing member 215 of the magnetic lifting apparatus in accordance with the present invention. The circular magnetic polarity fixing member 215 is inserted into the connecting axle 12 which is connected to the tetragonal axle 6 (FIG. 13) and includes a raised portion 215' disposed thereon. An inside stopper 217 of an inside supporting plate 216 is attached to the circular plate 14 (FIG. 12) for stopping the circular fixing member 215 in a one-way direction.

As shown in FIGS. 16–17, the magnetic lifting apparatus according to the present invention operates as follows. After an object to be lifted or moved is located under the bottom face of the magnetic lifting apparatus of the present inventions, the crane or hoist controlled by the remote controller clamps the link 8" of the operating member 8 through a hook (not shown) thereof, and lifts and moves the magnetic lifting apparatus of the present invention. Thereafter, the bottom face of the magnetic lifting apparatus of the present invention is located on an object such as steel plates 20 or the like to be lifted or moved.

At this time, as shown in FIG. 16, when the steel plates 20 have a long and wide size, a number of magnetic lifting apparatuses can be used after the apparatus are arranged in the equal space of each other. Therefore, all magnetic apparatuses lift and move in a same time.

Figure 4:
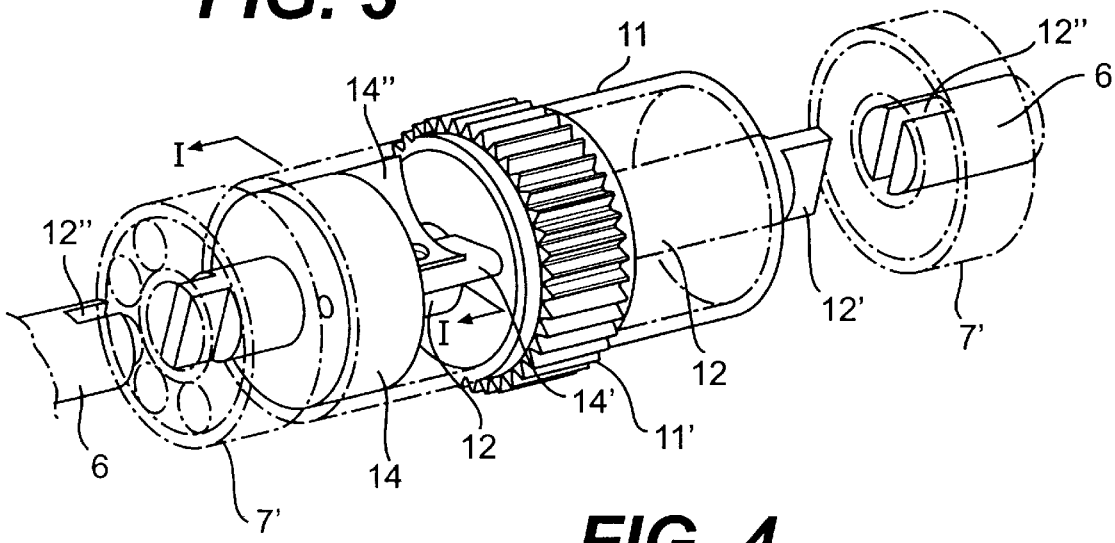
FIG. 4 is an exploded perspective view of "c" portion of FIG. 2.

As shown in FIGS. 17(A)–17(F), when the magnetic lifting apparatus of the present invention is lifted from the stop position by the hook of the crane or hoist, the operating member 8 moves up earlier than the body member 1 thereof as shown in the dotted lines position in FIGS. 3 and 5. When the operating member 8 moves up, the rack gear 10 rotates up and makes the ring gear 11 rotate in the clockwise direction (FIG. 3). Therefore, the rotor seat member 5 rotates 180° in the clockwise direction since the rotor seat member 5 engages with the tetragonal axle 6 connected to the connecting axle 12, and the connecting axle 12 rotates by rotation of the ring gear 11' (FIG. 4).

Accordingly, the magnetic polarity of the pair of magnetic rotors 5 are the same as the magnetic polarity of the pair of permanent magnets N and S of the rotor seat member 25, so that the magnetic substance 4 has a strong magnetic activity so as to attach the object such as the steel plates as shown in FIG. 17(B) from FIG. 17(A). At this time, the end stopping portion 13' of the cam configured member 13 stops against the cam stopper 14' pivotally connected to the pivot pin 14'" and resiliently contacted with the resilient spring 14" (FIG. 4). Also, the stopping portion 15' of the circular magnetic polarity fixing member 15 stops against the stopper 17 of the stopper supporting plate 16 as shown in FIG. 7. Therefore, the magnetic lifting apparatus according to the present invention becomes more stable especially if any impact is applied to the apparatus. The stability is attributed to the tetragonal axle 6 being slidably inserted in the tetragonal axial aperture 6' and the cam stopper 14 and the stopper 17 preventing rotation of the connecting axle 12 and the tetragonal axle 6, respectively, so that the tetragonal axle 6 will not twist under any impact.

After finishing the lift and movement as shown in FIG. 17(C), the magnetic lifting apparatus of the present invention positions the lifted object 20 as shown in FIG. 17(D). At this time, since the operating member 8 is released from the weight of the object 20 and the body member 1, the operating member 8 moves down through the opening 2" as shown in FIGS. 17(E) from FIG. 17(D).

At this time, the rack gear 10 moves down and rotates the ring gear 11' in the counter clockwise direction. Since the cam stopper 14' freely rotates, the connecting axle 12 and the tetragonal axle 6 do not rotate. Accordingly, the magnetic activity of the magnetic lifting apparatus of the present invention still is effective as shown in FIG. 17(E).

In order to deactivate the magnetic activity of the magnetic substance 4, the operating member 8 must move up by operating the crane or hoist. At this time, the operating member 8 moves up. And then simultaneously the rack gear 10 moves up and rotates the ring gear 11' in the clockwise direction. Also, the connecting axle 12 and the tetragonal axle 6 rotate too in the clockwise direction, so that the magnetic rotor 5 rotates 180° again. Therefore, the rotor seat member 25 changes the magnetic polarity. That is, the magnetic polarity of the pair of magnetic rotors 5 is different from the magnetic polarity of the pair of permanent magnets N and S so that the magnetic activity of the magnetic substance 4 automatically deactivates and the object 20 is separated from the body member 1 of the magnetic lifting apparatus according to the present invention as shown in FIG. 17(F).

Also, when the pair of circular magnetic fixing members 15 rotate 180° again, the magnetic rotor 5 rotates since the circular magnetic fixing member 15 is attached to both ends of the tetragonal axle 6. Accordingly, the reacting stopping portion 15' of the circular magnetic fixing members 15 is adopted to stop by the stopper lever 17' of the stopper 17 attached to the stopper supporting plate 16.

As shown in FIGS. 9 and 11–13, instead of the circular magnetic polarity fixing member 15, there are additional circular magnetic polarity fixing members 115 and another additional circular magnetic polarity fixing member 215 for stopping the stopper in the one way direction. Accordingly, the circular magnetic polarity fixing members 15, 115, and 215 have the same function in the magnetic lifting apparatus in accordance with the present invention. Upon rotating these circular magnetic polarity fixing members, respectively, the magnetic lifting apparatus does not twist in the case that the apparatus either has magnetic activity or no magnetic activity so as to attach or release form the object.

Also, since the first magnetic center zones 5' of the rotor seat members 5 are in a slant position, approximately 5–7° about the second magnetic center zones 4' of the magnetic substances 4 respectively, the rotor seat members 5 of the magnetic apparatus of the present invention do not rotate so as to prevent an accident. Accordingly, the magnetic lifting apparatus of the present invention does not require any additional safety facility, so that the magnetic lifting apparatus is simple in structure, durable in use, inexpensive to manufacture, and refined in appearance.

The body member 1 of the magnetic lifting apparatus according to the present invention has more weight than the force with which one magnetic rotor 5 rotates. Therefore, if one magnetic rotor 5 gets out of order, the antireactive force of the inactive magnetic rotor 5 does not give any influence to the active magnetic rotors 5.

Also, the weight of the body member 1 of the magnetic lifting apparatus according to the present invention is heavier than the loading weight which changes a reacting magnetic polarity between the magnetic rotor 5 and the permanent magnet 5" of the rotor seat member 25 when the magnetic rotor 5 rotates 180°. Another advantage of the magnetic lifting apparatus according to the present invention is the stability if any impact is applied to the apparatus since the magnetic substances are attached to the top cover 2 by the plurality of screw bolts 21 and fixed to the side walls 3' with a melting method, such as a composite resin.

Accordingly, the magnetic lifting apparatus of the present invention is firmly covered by both side wall covers 3 and the top cover 4, so that the apparatus can withstand any impact and so that the tetragonal axle 10' will not twist under any impact.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A magnetic lifting apparatus comprising:

a housing defining a pair of side walls, a top cover, a bottom plate, and a pair of front and rear walls;

an operating member disposed in an opening of a center portion of said top cover, said operating member including a link and a pair of upper and lower edges for stopping the operating member at stopping portions extended from the circumference of said opening;

a tubular body member disposed within a hollow region of said opening, said tubular body including a ring gear surrounded on the central outer surface thereof, a first axle having a pair of convex ends extended from both ends thereof, and a circular plate, said axle having a cam configured member mounted thereon for stopping movement of said axle;

a rack gear connected to said operating member and disposed within said opening, said rack gear being in a gearing relationship with the ring gear to rotate the ring gear of the tubular body member during movement of said operating member;

a plurality of rotor seat members disposed within said housing, each rotor seat member including a magnetic rotor having a non-magnetic center zone, an angular axial aperture disposed at the center thereof, and a pair of permanent magnets;

a plurality of magnetic substances alternately aligned with said plurality of rotor seat members and disposed within said housing, each magnetic substance including a non-magnetic center zone and an angular axial aperture for matching with said angular aperture of the rotor seat member and disposed at the center thereof;

a pair of second and third axles passing through said angular axial apertures and connected to said pair of convex ends of the connecting axle by concave ends disposed ends thereof; and means for locking said magnetic apparatus in one of an activated or deactivated position, said means for locking connected to one of said pair of axles and said connecting axle for stopping a stopper in a one way direction, whereby upon lifting the operating member, since the rack gear goes up for rotating the ring gear in the clockwise direction and the magnetic rotor rotates so as to match the rotor with the permanent magnets in same plurality, the magnet lifting apparatus is in an on-position to attach to an object to be lifted or moved, and after lifting or moving, upon lifting the operating member, sine the magnetic rotor is unmatched with the permanent magnets in an opposing polarity, the magnetic lifting apparatus is in an off-position to release from the object.

2. The magnetic lifting apparatus of claim 1, wherein said rotor seat members and said magnetic substance are about 3 to 10 in number, respectively.

3. The magnetic lifting apparatus of claim 1, wherein said cam member includes a pair of stopping portions, a cam stopper pivotally connected to a pivot pin and resiliently contacted with a spring fixed to the circular plate whereby after the ring gear rotates in the clockwise direction, the ring gear stops thereto and when the ring gear rotates in the counter clockwise direction, the ring gear rotates freely.

4. The magnetic lifting apparatus of claim 1, wherein said means for locking includes a pair of circular magnetic polarity fixing members attached to both outside ends of said pair of second and third axles, said each circular magnetic polarity fixing member having a pair of stopping portions symmetrically located thereon for stopping by a stopper lever of a stopper mounted on the front or rear wall.

5. The magnetic lifting apparatus of claim 1, wherein said means for locking includes a pair of circular magnetic polarity fixing members attached to both outside ends of said second and third axles, said each circular magnetic polarity fixing member having a circular cap with an aperture for screwedly receiving a screw bolt, a spring and a stopping rod, and a pair of recesses symmetrically disposed thereon for stopping the stopping rod.

6. The magnetic lifting apparatus of claim 1, wherein said means for locking includes a circular magnetic polarity fixing member inserted by said connecting axle, a raised portion, and an inside stopper of an inside supporting plate mounted on said circular plate.

7. The magnetic lifting apparatus of claim 1, wherein said second and third axles and said axial aperture are square in cross-section, respectively.

8. The magnetic lifting apparatus of claim 1, where in said tubular body member is supported by a support stand on said bottom plate of the housing.

9. The magnetic lifting apparatus of claim 1, wherein said each magnetic substance is made of materials which can have a magnetic activity.

10. The magnetic lifting apparatus of claim 1, wherein said first, second, and third axles are supported by bearings disposed around regions where said axles connect with each other.

* * * * *